United States Patent [19]

Hunter et al.

[11] 4,413,441

[45] Nov. 8, 1983

[54] MULTIPLE FUNCTION DOLL

[75] Inventors: Gary L. Hunter, Fountain Valley; Gabriel Marason, Jr., Los Angeles; Diana C. Troup, Cerritos, all of Calif.

[73] Assignee: Mattel, Inc., Hawthorne, Calif.

[21] Appl. No.: 319,493

[22] Filed: Nov. 9, 1981

[51] Int. Cl.[3] ..... A63H 3/24; A63H 13/02

[52] U.S. Cl. ..... 46/116; 46/119; 46/141

[58] Field of Search ..... 46/141, 135 A, 116, 46/117, 119, 118

[56] References Cited

U.S. PATENT DOCUMENTS

| | | | |
|---|---|---|---|
| 3,260,015 | 7/1966 | Ryan | 46/117 |
| 3,568,802 | 3/1971 | Marshall | 185/39 |
| 3,583,093 | 6/1971 | Glass et al. | 46/117 |
| 3,775,901 | 12/1973 | Ellman et al. | 46/141 |

FOREIGN PATENT DOCUMENTS

| | | | |
|---|---|---|---|
| 2113366 | 10/1971 | Fed. Rep. of Germany | 46/141 |
| 2216008 | 10/1973 | Fed. Rep. of Germany | 46/116 |

*Primary Examiner*—F. Barry Shay

*Attorney, Agent, or Firm*—Reagin & King

[57] ABSTRACT

A multiple function doll is disclosed which includes a controlled wetting function. Wetting is effected automatically whenever the doll is placed on a toy toilet. The wetting function is controlled by a pinch valve which prevents the flow of water from a reservoir to a wetting orifice. Placing the doll on a toy toilet automatically opens the pinch valve. The doll also includes a hand clapping function which is driven by a spring motor. The spring motor is in turn controlled by a switch mechanism which permits a child to start and stop the hand clapping.

7 Claims, 12 Drawing Figures

Fig. 2.
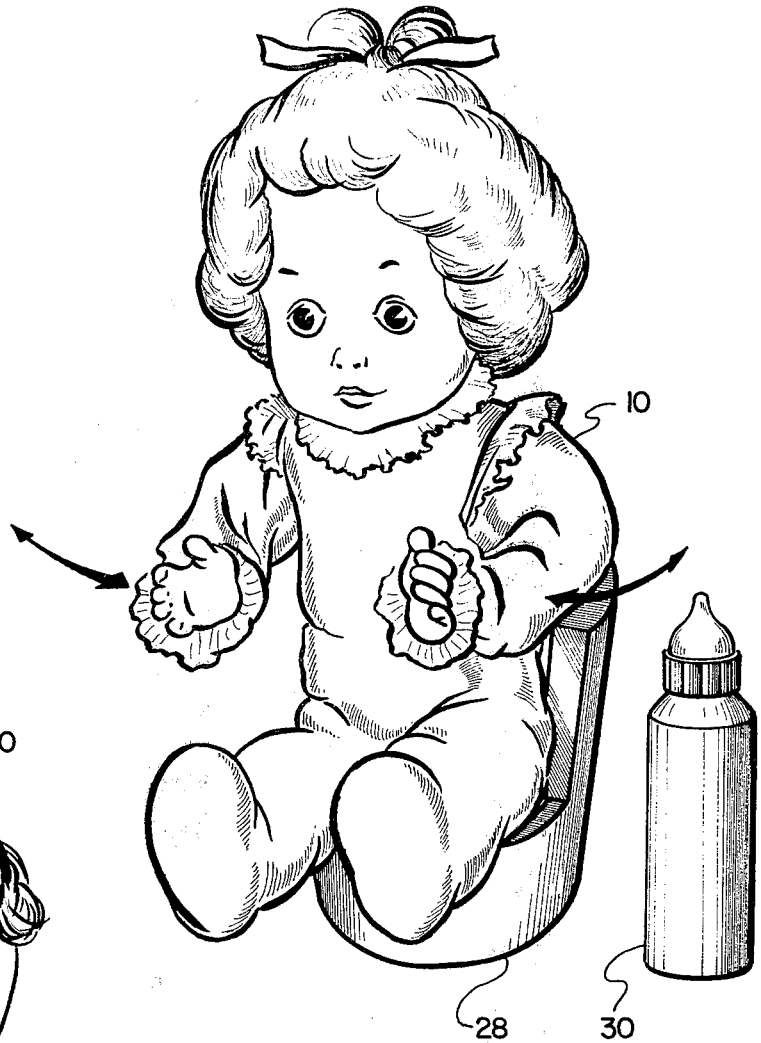
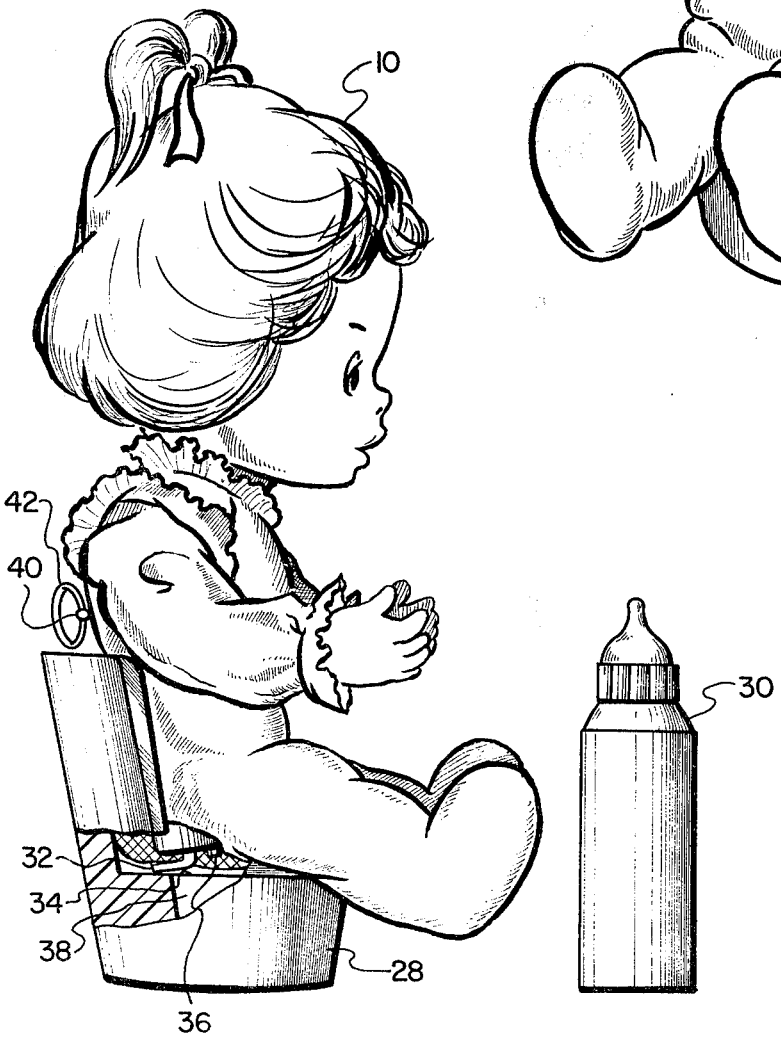
Fig. 3.

56
54
44
26
36
32
52
50
48
40
10
46
130
134
42

Fig.7.
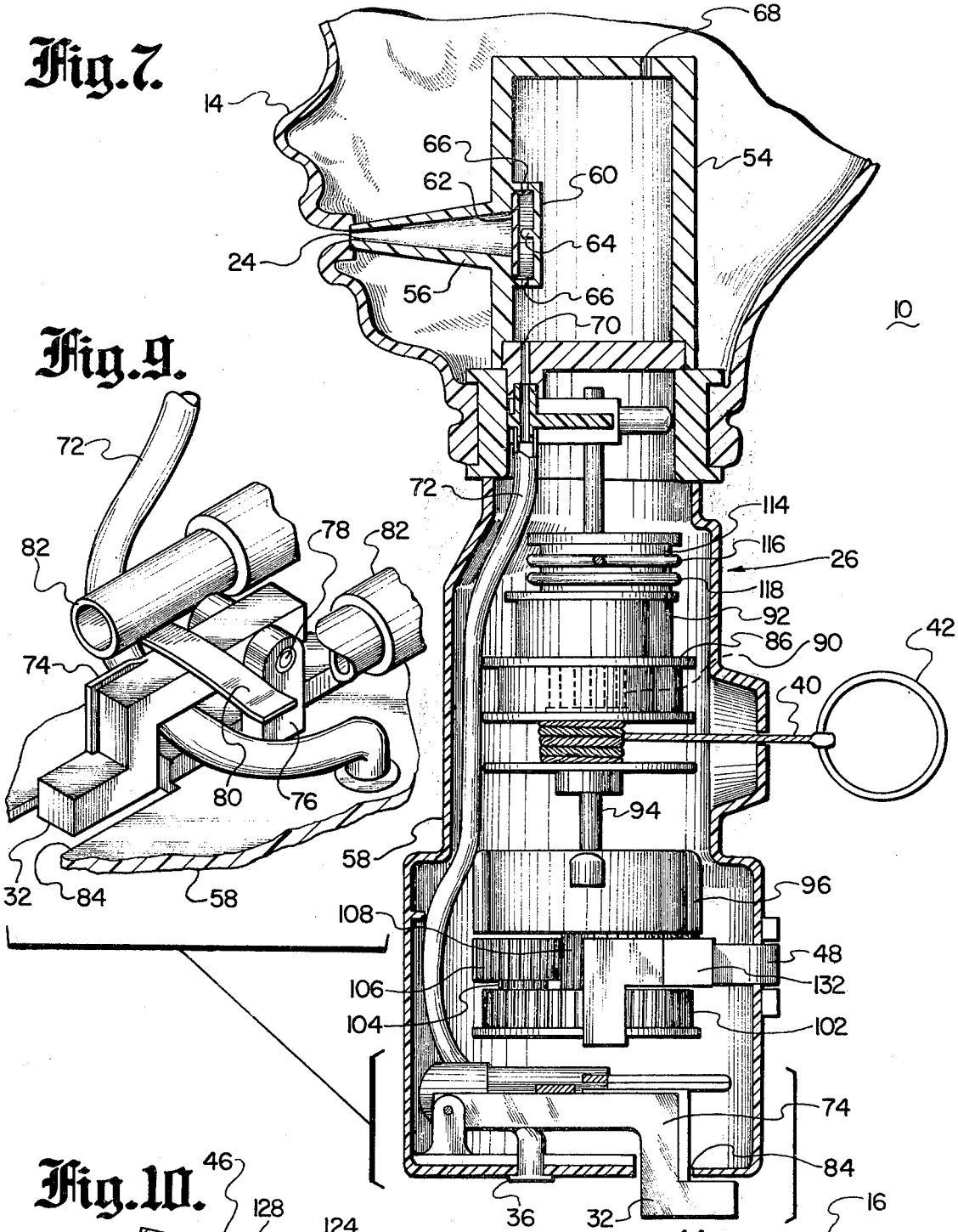
Fig.9.
Fig.10.
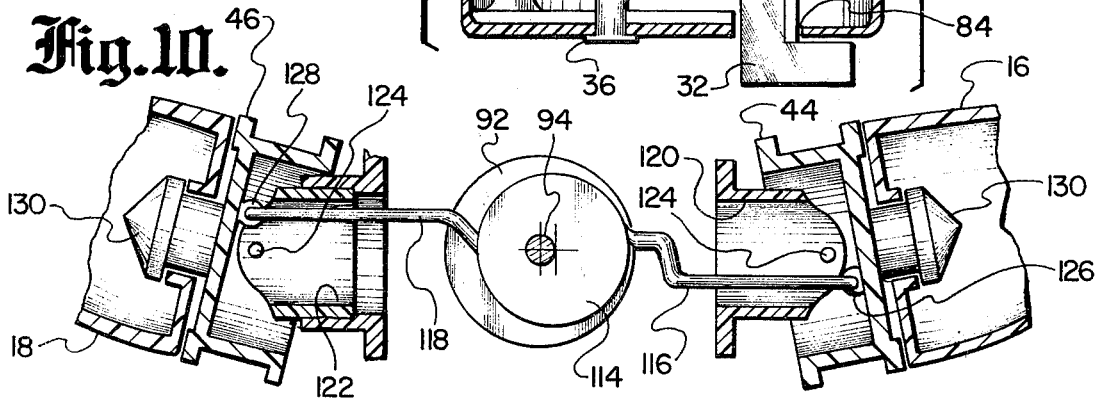

MULTIPLE FUNCTION DOLL

BACKGROUND OF THE INVENTION

This invention relates to dolls, and more particularly to improved dolls capable of performing a number of functions.

There have been many types of dolls devised over the years. A number of such dolls have been provided with mechanisms which allow them to simulate various functions of a baby such as wetting. Most such wetting dolls are adapted to wet in response to liquid introduced into the doll's body through its mouth. The wetting mechanism generally consists of a tube connecting an orifice at the mouth to the wetting orifice. Two such dolls are shown in Rekettye U.S. Pat. No. 2,907,139 issued Oct. 6, 1959 and Lyons, et. al. U.S. Pat. No. 4,160,338 issued July 10, 1979. One problem of this type of wetting doll is that no control is provided for the wetting function.

In an attempt to overcome the problem of uncontrolled wetting, mechanisms have been developed which include complicated tubing arrangements which cooperate with a water reservoir and a pump to achieve controlled wetting. An example of such a controlled wetting mechanism is shown in Hollingsworth, et. al. U.S. Pat. No. 3,839,819 issued Oct. 8, 1974. Mechanisms of this type require the doll body to be sequeezed a number of times to prime the pump before the pump will force liquid through a wetting orifice. This sort of controlled wetting mechanism is quite complicated and requires a child to manipulate the body of the doll in an unrealistic manner to effect wetting. The complicated controlled wetting mechanisms of this type take up a substantial amount of space so that it has been extremely difficult to cause such dolls to perform additional functions. A multiple function doll which performs the functions of crying and armwaving, and which employs a unitary watertight mechanism is described in U.S. patent application Ser. No. 117,746, filed Feb. 1, 1980, now U.S. Pat. No. 4,339,889, entitled MULTIPLE FUNCTION DOLL, assigned to the assignee of this invention.

It is accordingly an object of the present invention to provide an improved multi-function toy doll.

It is another object of this invention to provide a toy doll having a controlled wetting function which employs a simplified mechanism.

It is an additional object of this invention to provide a toy doll having a controlled wetting function which may be automatically activated by a child without exaggerated motions.

It is yet another object of this invention to provide a multiple function toy doll which is capable of both controlled wetting and the clapping of its arms.

SUMMARY OF THE INVENTION

The foregoing and other objects of the invention are accomplished by a toy doll having a simplified controlled wetting mechanism including a reservoir having an inlet which communicates with the mouth of the doll. The outlet of the reservoir is connected by a single, flexible tube to a wetting orifice. The wetting function is controlled by means of a pinch valve comprising a lever which is spring biased to exert pressure on the side of the flexible tube to pinch off the flow of water. The lever includes an arm which extends outward from the doll body at the bottom of the torso.

In operation, the reservoir is filled with fluid by means of a squeeze bottle inserted into the doll's mouth. The doll is then placed on a seat of a toy toilet which causes the arm of the pinch valve lever to be depressed in a manner which opens the pinch valve and allows the fluid to flow out of the wetting orifice into the toilet.

The use of the simplified controlled wetting mechanism described above allows a spring motor and other mechanized parts to be included within the body of the doll. The motor is adapted to drive a rotating mechanism which provides output to drive both of the doll's arms to simulate clapping. A push button mechanism is included in the back of the doll to permit the child to start and stop the clapping action.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 2 is a front perspective view of the baby doll shown in FIG. 1, with the doll sitting on a toy toilet;

FIG. 3 is a side view of the baby doll shown in FIG. 2, partially cut away to show the operation of the controlled wetting mechanism of the doll;

FIG. 7 is a side view, partially cut away and partially in cross-section, of the internal mechanism shown in FIGS. 4, 5, and 6;

FIG. 9 is an enlarged, perspective view of a detail of the internal mechanism shown in FIG. 7;

FIG. 10 is a cross-sectional view of a portion of the internal mechanism taken along the line 10—10 of FIG. 5;

DESCRIPTION OF THE PREFERRED EMBODIMENT

Figure 1:
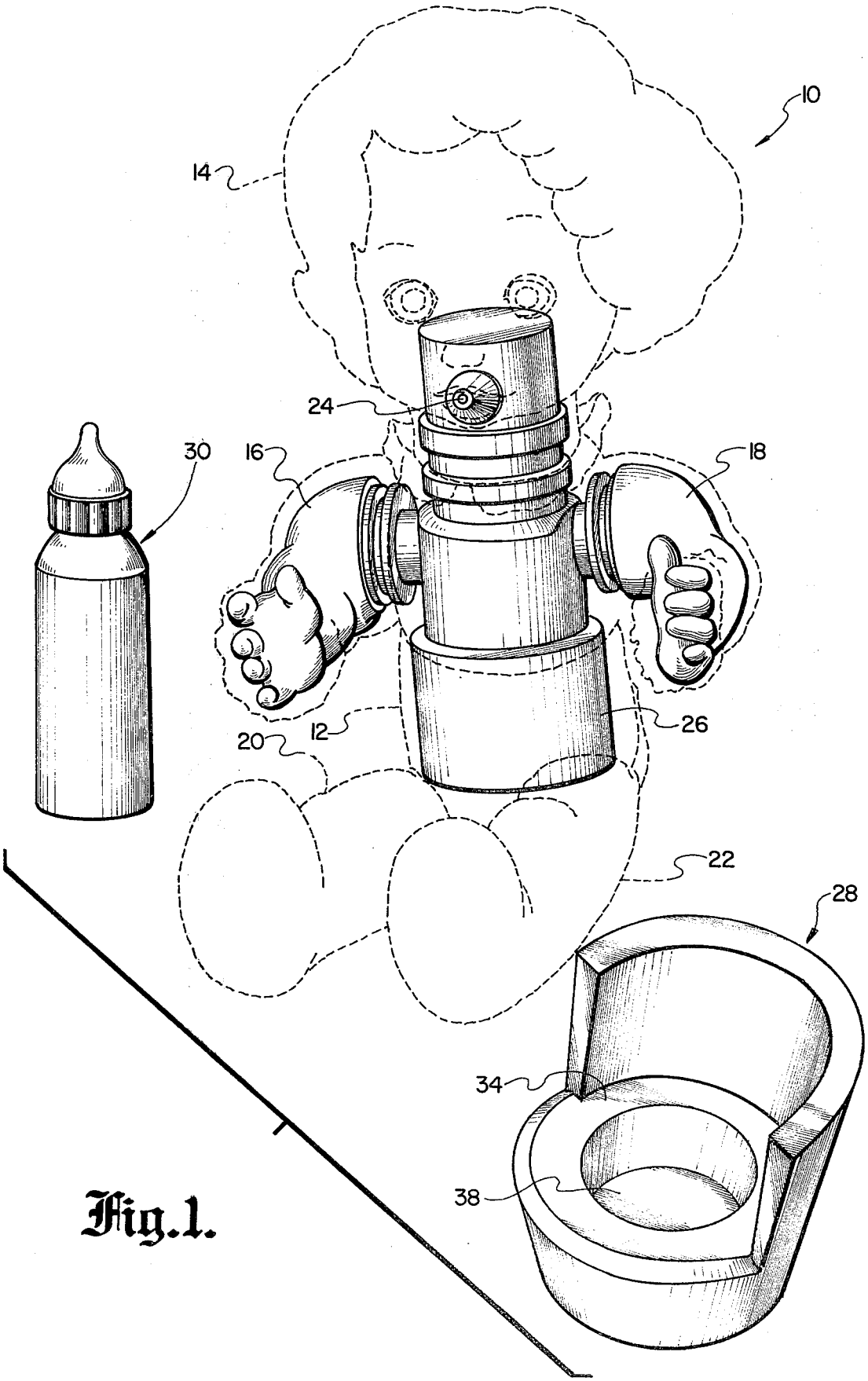
FIG. 1 is a perspective view of a baby doll constructed in accordance with the invention.

Referring now to the drawings, and more particularly to FIG. 1, there is shown a toy doll 10 constructed in accordance with the invention. The doll 10 has a body 12, shown in dotted lines, which, in a preferred embodiment, may be constructed using a soft cloth material. The body 12 supports a head 14, a pair of arms 16 and 18, and a pair of legs 20 and 22. The head 14 of the doll has a mouth 24 as well as other features which are not important to the understanding of this invention. The mouth 24 is connected to a mechanism 26 within the body 12 of the doll 10 which may be operated to cause the doll 10 to wet through a wetting orifice (not shown in FIG. 1) whenever the doll 10 is placed on a toy toilet 28. The mouth 24 provides an orifice through which water or other fluid may pass from a bottle 30.

The mechanism 26 may also be operated to cause the arms 16 and 18 to clap.

The small size of the mechanism 26 relative to the mechanisms usually required for operating a multi-function doll should be noted. The small size of the mechanism 26 allows the doll body to be small in size. Further, the construction of the mechanism 26 is such that the doll 10 may be constructed of a material including soft cloth which is pleasing to a child.

Referring now to FIGS. 2 and 3, there are shown front and side perspective views, respectively, of the doll 10 sitting on the toy toilet 28. The view in FIG. 3 is partially cut away to show that when the doll 10 is sitting on the toy toilet 28, a lever arm 32 which extends from the bottom of the torso of the doll 10 is in contact with a rim 34 of the toy toilet 28. It can also be seen that a wetting orifice 36 is provided at the bottom of the torso of the doll 10 above a bowl portion 38 of the toy toilet 28. As described below, placing the doll 10 on the toy toilet 28 depresses the lever arm 32 which enables the doll 10 to wet into the toy toilet 28 via the orifice 36.

Figures 4, 5, 6:
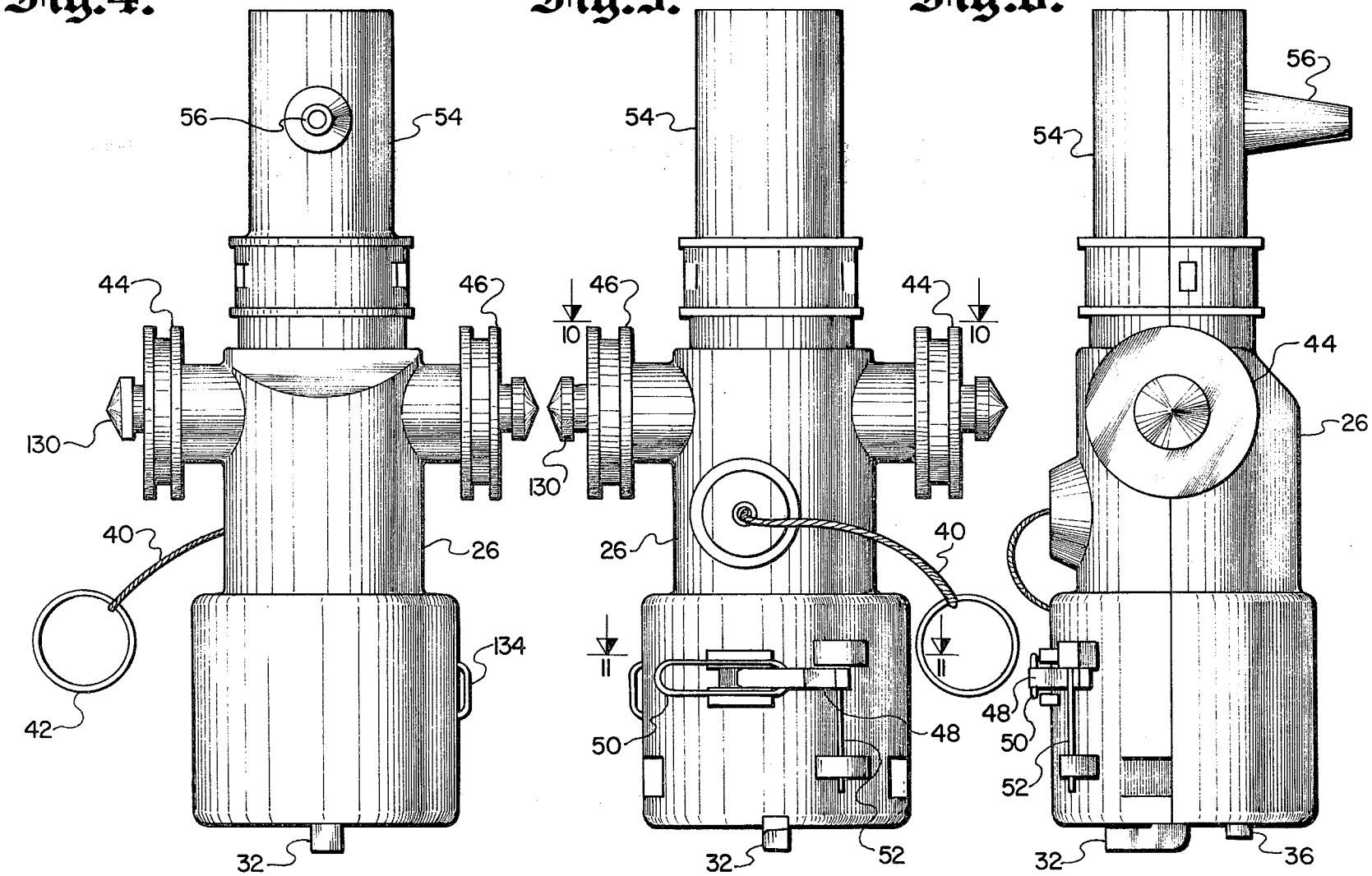
FIG. 4 is a front view of the internal mechanism of the baby doll shown in FIG. 1.
FIG. 5 is a rear view of the internal mechanism of the baby doll shown in FIG. 1.
FIG. 6 is a side view of the internal mechanism of the baby doll shown in FIG. 1.

FIGS. 4, 5, and 6 are, respectively, front, rear, and side views of the mechanism 26. Projecting from the rear of the mechanism 26 is a pull string 40 connected to a ring 42. The string 40 extends through the rear of the body of the doll 10 (as shown in FIG. 3) and is connected to a spring motor within the mechanism 26. Pivotably attached to the sides of the mechanism 26 are arm connectors 44 and 46, which are coupled, respectively, to the arms 16 and 18 of the doll 10. The release of the spring motor within the mechanism 26 is controlled by a switch assembly mounted on the rear of the mechanism 26 and comprising an actuator 48, a cantilevered spring 50, and a retainer spring 52.

Affixed to the top of the mechanism 26 is a reservoir 54 which is coupled to the mouth 24 of the doll 10 by means of a projecting orifice 56. Extending from the bottom of the mechanism 26 is the lever arm 32 and the orifice 36.

Figure 8:
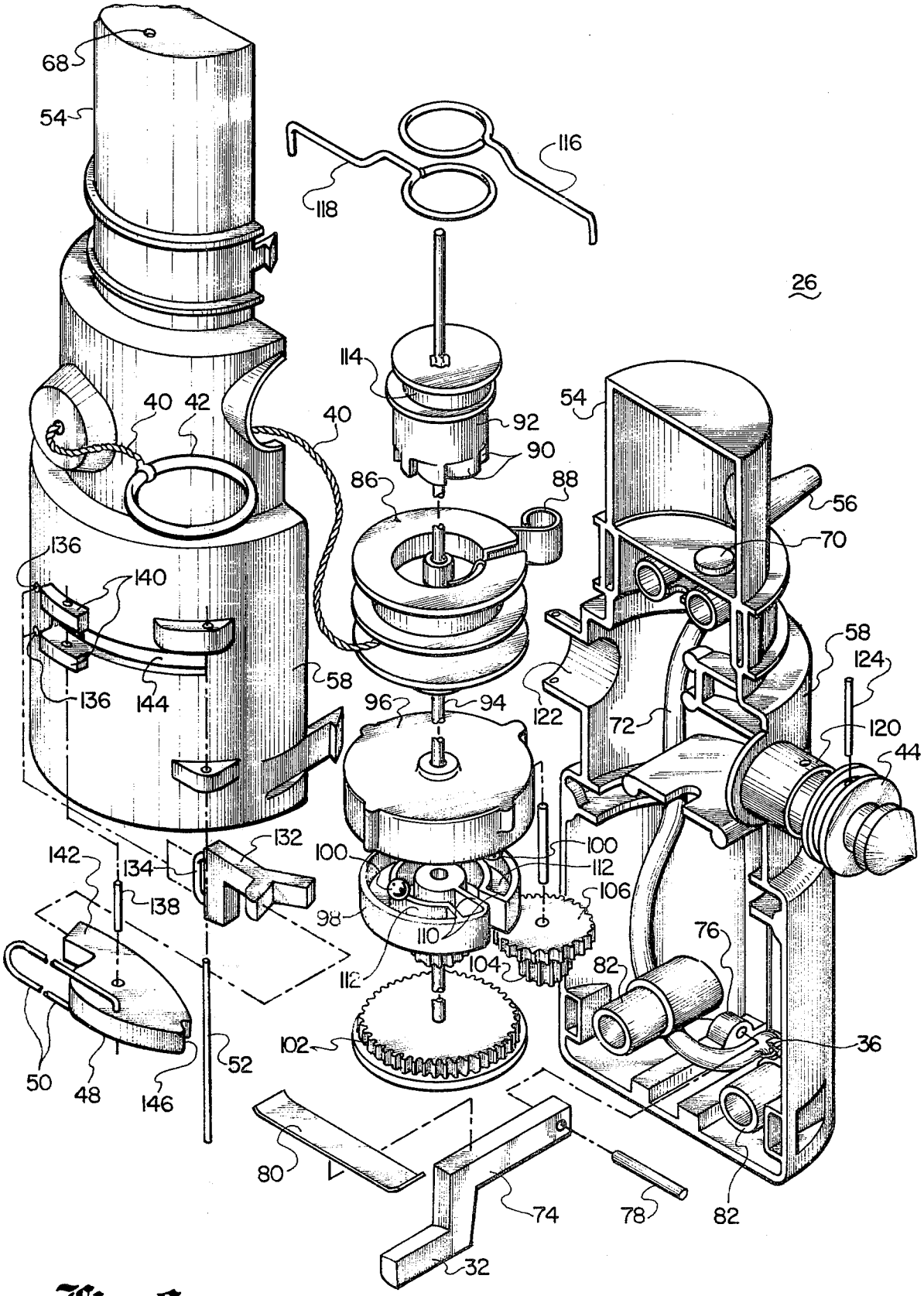
FIG. 8 is an exploded, perspective view of the internal mechanism shown in FIG. 7.

In FIGS. 7 and 8 there are shown a cut-away side view and an exploded perspective view, respectively, of the mechanism 26. The mechanism 26 includes a plastic housing 58 formed in two sections which are designed to snap together using fasteners (not shown) in a manner well known to those skilled in the art. The controlled wetting portion of the mechanism 26 includes the fluid reservoir 54 which receives water or other fluid from the bottle 30 when it is inserted into the mouth 24 of the doll 10.

The fluid enters the reservoir 54 through both the orifice 56 and a check valve comprising a cylindrical support 60 containing a thin flexible diaphragm 62 which may be formed of vinyl, rubber, or other flexible material. The diaphragm 62 is held against the opening at one end of the orifice 56 by means of a projection 64 extending from the center of the support 60. Under the pressure exerted by squeezing the bottle 30, the outer edge of the flexible diaphragm 62 bends to the right in FIG. 7 and permits the fluid to enter the reservoir 54 via openings 66 in the support 60. A small air vent 68 in also provided in the top of the reservoir 54.

An opening 70 is provided in the bottom of the reservoir 54 and leads to a resilient flexible tube 72 which extends the length of the mechanism 26 and exists the bottom thereof through the orifice 36.

A pinch valve, shown in detail in FIG. 9, is located at the bottom of the mechanism 26 and is used to control the wetting action of the doll 10. Referring to FIGS. 7, 8, and 9, the pinch valve includes a lever 74 which is pivotably mounted to supports 76 within the housing 58 by means of a pin 78. The flexible tube 72 is routed to pass underneath the lever 74. The lever 74 is biased by means of a leaf spring 80 to press down and pinch off the flexible tube 72 by squeezing it between the lever 74 and the bottom of the housing 58. The spring 80 is held in place by adhesive attachment to posts 82 which project horizontally from the inside of the housing 58 above the lever 74. When the tube 72 is pinched off, no fluid can flow from the reservoir 54 to the orifice 36.

One end of the lever 74 is the lever arm 32 which projects through the bottom of the housing 58 via opening 84. By pressing the lever arm 32 upward towards the housing 58, the pressure closing off the tube 72 is relieved, permitting fluid to flow from the reservoir 54 through the tube 72 and to exit the orifice 36.

When a child plays with the doll 10, water is introduced into the reservoir 54 through the mouth 24 by means of the bottle 30. Referring to FIG. 3, the doll may be caused to automatically wet by setting it on the toy toilet 28. The lever arm 32, which may be hidden from sight beneath the soft cloth material of the doll body 12, is depressed by contact with the rim 34 of the toy toilet 28. This action opens the pinch valve and allows the doll 10 to wet into the toy toilet 28 through the orifice 36. The wetting may be automatically stopped at any time by simply lifting the doll 10 from the toy toilet 28. Accordingly, the child has complete and automatic control of the wetting function.

FIGS. 7 and 8 show the hand-clapping portion of the mechanism 26. When the ring 42 is pulled, the string 40 is withdrawn from the body 12 of the doll 10, causing the rotation of a spool 86 to which is affixed a negator spring 88. A free end of the spring 88 within an upwardly facing cylindrical cavity in the spool 86 bears against a cylindrical, gear-faced ratchet surface 90. The surface 90 projects into the cavity of the spool 86 from the lower surface of a rotating cam 92. The free end of the spring 88 rotates freely in one direction but will not move in the other direction against the gear surface 80 when the string 40 is withdrawn from the body 12 of the doll 10. Consequently, withdrawal of the string 40 unwinds the spring 88.

When the ring 42 and the string 40 are released, the spring 88 may rotate the spool 86 and the cam 92 driving an inner drive shaft 94 coaxially affixed thereto. The drive shaft 94 projects downwardly and moves freely through a governor consisting of a housing 96, a rotating mechanism 98 and a pair of ball weights 100. The shaft 94 is fixed at its lower end to a gear 102 which rotates a spur gear 104. The spur gear 104 drives an idler gear 106 attached thereto to rotate a governor gear 108 projecting from and attached to the rotating mechanism 98. The mechanism 98 is molded of a relatively soft plastic and has thin sections 110 connecting outer chamber 112 to its axis.

The rotation of the mechanism 98 within the housing 96 causes the ball weights 100 to spin to an outer position. The exterior surfaces of the chambers 112 bear against the interior of the housing 96, exerting friction and thereby maintaining the top speed of rotation of the governor and the shaft 94 below a particular limit. The mechanism thus described performs the function of a controlled speed spring motor and is similar in construction to the mechanism described in U.S. Pat. No. 4,337,889.

Affixed to the top surface of the rotating cam 92 is an eccentric pulley 114. Encircling the eccentric pulley 114 are a pair of connecting rods 116 and 118. The rods 116 and 118 extend through hollow cylindrical sleeves 120 and 122 formed in opposite sides of the mechanism 26 (see FIG. 10). The sleeves 120 and 122 are used to pivotably mount the arm connectors 44 and 46 by means of pins 124 so that the connectors 44 and 46 are free to pivot about a vertical axis. The ends of the connecting rods 116 and 118 are connected to the arm connectors 44 and 46 at hinge points 126 and 128, respectively. As shown in FIG. 10, the hinge points 126 and 128 are on opposite sides of the pivot pins 124. The arms 16 and 18 of the doll 10 are rotatably attached to the arm connectors 44 and 46 by means of projections 130 whereby the arms 16 and 18 may be pivoted up and down about a horizontal axis.

As the eccentric pulley 114 rotates, the connecting rods 116 and 118 move horizontally in unison in a reciprocating manner. When the rods 116 and 118 move to the right as shown in FIG. 10, the positions of the hinge points 126 and 128 cause the connectors 44 and 46 to pivot about the pins 124 in a fashion which causes the arm 16 and 18 to move together. When the rods 116 and 118 move to the left, they cause the connectors 44 and 46 to pivot in a fashion which causes the arms 16 and 18 to move apart. Accordingly, the arms 16 and 18 move together and apart in a clapping fashion as they pivot about the pins 124. To effect control of the clapping action of the doll 10 described above, a switch mechanism is included to allow a child to start and stop the clapping motion.

Figure 11:
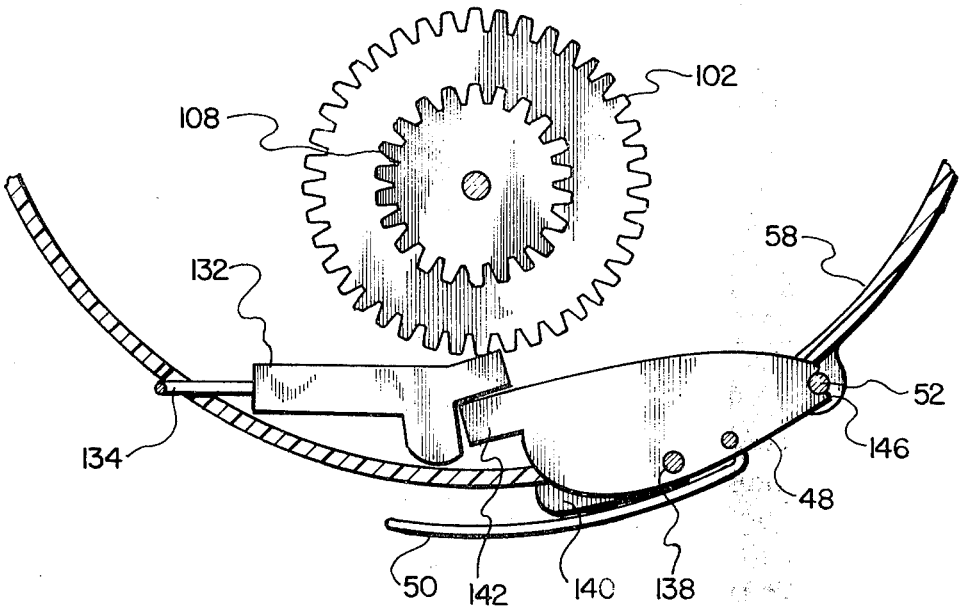
FIG. 11 is a cross-sectional view of a portion of the internal mechanism taken along the line 11—11 of FIG. 5 and showing a motor control switch in the run position.

Referring to FIGS. 5, 8, and 11, the switch mechanism for controlling the clapping action includes a control lever 132 which is pivotably connected to the side of the housing 58 by means of a U-shaped pin 134 which extends through holes 136 in the housing 58. The actuator 48 is pivotably mounted to the rear of the housing 58 by means of pin 138 and bosses 140, as shown in FIG. 8. A portion of the actuator 48 including leg 142 extends into the interior of the housing 58 through a slot 144. As shown in FIG. 11, the leg 142 engages a portion of the control lever 132 within the housing 58. Pivotably mounted to the outer portion of the actuator 48 is the cantilever spring 50. A notch 146 is provided at one end of the actuator 48 and is designed to engage the retainer spring 52 which is resiliently mounted at its ends to the housing 58.

The operation of the switching mechanism described above may be explained by referring to FIGS. 11 and 12. The actuator 48 and the cantilever spring 50 may each be depressed by the child by applying pressure through the cloth body at the back of the doll 10. When the actuator 48 is depressed, the notch 146 engages the retainer spring 52 which holds the actuator 48 in the position shown in FIG. 11. In this position, the leg 142 of the actuator 48 holds the control lever 132 against the housing 58. Assuming the child has actuated the pull string 40, the spring motor and the eccentric pulley 114 rotate. Accordingly, when the switch mechanism is in the position shown in FIG. 11 the arms 16 and 18 of the doll 10 clap.

Figure 12:
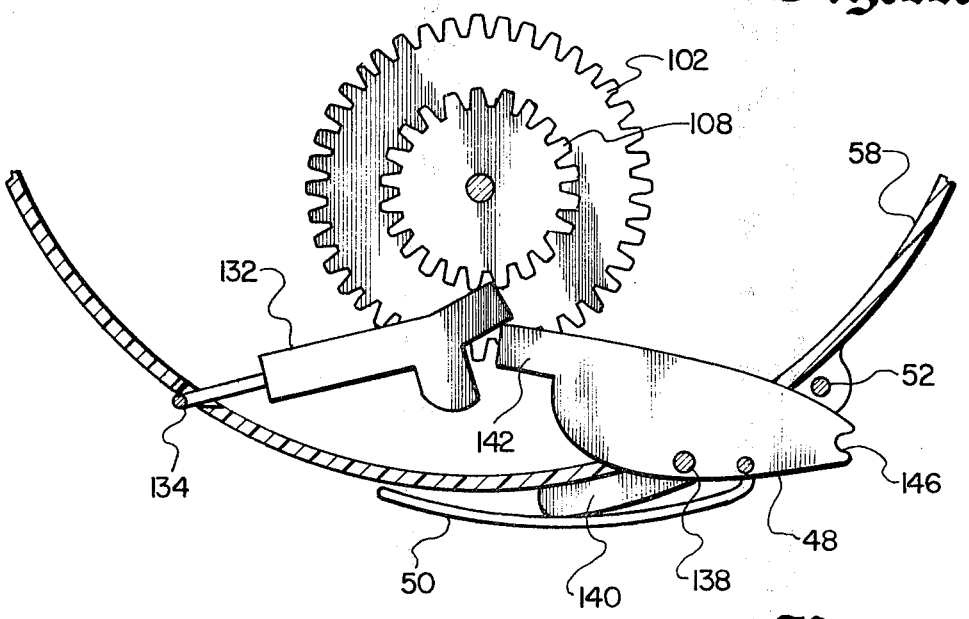
FIG. 12 is a sectional view, similar to FIG. 11 but showing the control switch in the stop position.

The child may stop the clapping action by depressing the cantilevered spring 50 as shown in FIG. 12. The cantilever spring 50 rotates about the bosses 140 and forces the actuator 48 to rotate clockwise as shown in FIG. 12 whereby the notch 146 disengages from the resilient retainer spring 52. This action causes the leg 142 of the actuator 48 to force the control lever 132 to engage the teeth of the governor gear 108. The governor gear 108 is thus prevented from rotating, causing the entire spring motor mechanism to stop. Accordingly, the doll 10 stops clapping. Clapping may be recommenced by again depressing the actuator 48. Retainer spring 52 acts to hold the actuator 48 in the last actuated position.

When desired, the child may cause the doll's arms 16 and 18 to clap by pulling the string 42 and depressing the actuator 48. Clapping may be stopped at any time by depressing the cantilever spring 50. The actuator 48 and spring 50 may also be hidden from view beneath the soft cloth material of the doll body 12.

The entire mechanism 26, as may be understood from the foregoing description of the figures, is formed as a single self-contained watertight internal element which is placed within the body 12 of the doll 10. This configuration allows the body 12 of the doll 10 to be formed of soft material including cloth. Furthermore, the mechanism 26 includes only a very small number of moving parts to provide a multiplicity of operating functions. Thus, the mechanism 26 of the doll 10 is much less likely to fail than are mechanisms of the prior art. In addition, the mechanism 26 of the present invention is quite inexpensive to construct. The interior portions of the mechanism 26 are made of various moldable plastics which may be easily shaped by those skilled in the art to perform the indicated functions.

While the invention is disclosed in a particular embodiment and described in detail, it is not intended that the invention be limited solely to this embodiment. Many modifications will occur to those skilled in the art which are within the spirit and scope of the invention. It is thus intended that the invention be limited in scope only by the appended claims.

What is claimed is:

1. A doll comprising a body; a controlled wetting mechanism positioned in the body including a reservoir for fluid, conduit means for conducting the fluid from the reservoir to an exit opening adjacent the bottom of the torso of the doll, valve means for starting and stopping the flow of the fluid out of the exit opening, and actuating means for automatically operating the valve whenever the doll is placed on a toy toilet; two arms, each pivotably mounted to the body and having a hand attached thereto; and a hand-clapping mechanism positioned in the body including a spring motor, an eccentric pulley driven by the motor, and means linking the pulley to the arms, whereby the arms are moved to simulate clapping by the operation of the motor.

2. The doll as claimed in claim 1 in which the conduit means includes flexible tubing having a resilient wall, and the valve means includes pinch means for applying pressure to the wall of the tubing to pinch off the flow of fluid.

3. The doll as claimed in claim 2 in which the actuating means includes a lever arm adjacent the bottom of the torso of the doll and operatively connected to the pinch means so that when the lever arm is depressed, pressure is removed from the tubing wall, allowing fluid to flow out of the exit opening.

4. The doll as claimed in claim 3 in which a portion of the toy toilet effects depression of the lever arm whenever the doll is placed on the toy toilet.

5. The doll as claimed in claim 4 in which the pinch means includes bias means for applying pressure to the wall of the tubing whenever the lever is not depressed, whereby the flow of the fluid is automatically stopped whenever the doll is removed from the toy toilet.

6. The doll as claimed in claim 5 in which the pinch means includes a lever pivotably mounted to contact the wall of the tubing, the bias means biases the lever to apply pressure to and pinch off the tubing, and in which the lever arm is connected to the lever so that depression of the lever arm opposes the bias means.

7. The doll as claimed in claim 1 further comprising means for starting and stopping the motor to effect control of the hand clapping.

* * * * *